US009687040B2

(12) United States Patent
Peikert et al.

(10) Patent No.: US 9,687,040 B2
(45) Date of Patent: Jun. 27, 2017

(54) FOOTWEAR WITH AIR PERMEABLE LAYER AND AIR PERMEABLE PORTION IN A LOWER PERIPHERAL AREA OF THE UPPER ARRANGEMENT

(71) Applicants: W.L. Gore & Associates GmbH, Putzbrunn (DE); W.L. Gore & Associates S.R.L., Verona (IT)

(72) Inventors: Marc Peikert, Wolfratshausen (DE); Russell Brill, Grafing (DE); Andrea Giupponi, Verona (IT)

(73) Assignees: W. L. Gore & Associates GmbH, Putzbrunn (DE); W. L. Gore & Associati, S.r.l., Verona (IT)

( * ) Notice: Subject to any disclaimer, the term of this patent is extended or adjusted under 35 U.S.C. 154(b) by 0 days.

(21) Appl. No.: 14/770,711

(22) PCT Filed: Mar. 15, 2013

(86) PCT No.: PCT/EP2013/055462
§ 371 (c)(1),
(2) Date: Aug. 26, 2015

(87) PCT Pub. No.: WO2014/139595
PCT Pub. Date: Sep. 18, 2014

(65) Prior Publication Data

US 2016/0000176 A1 Jan. 7, 2016

(51) Int. Cl.
*A43B 7/08* (2006.01)
*A43B 7/12* (2006.01)
*A43B 23/02* (2006.01)

(52) U.S. Cl.
CPC ..... *A43B 7/08* (2013.01); *A43B 7/085* (2013.01); *A43B 7/12* (2013.01); *A43B 7/125* (2013.01); *A43B 23/0235* (2013.01)

(58) Field of Classification Search
CPC ..... A43B 7/08; A43B 7/084; A43B 7/085; A43B 7/10
(Continued)

(56) References Cited

U.S. PATENT DOCUMENTS 1,390,929 A * 9/1921 Saudino ..... A43B 7/06 36/3 R
2,022,488 A * 11/1935 Calderazzo ..... A43B 7/06 36/3 A
(Continued)

FOREIGN PATENT DOCUMENTS

CN 102112019 A 6/2011
CN 102740719 A 10/2012
(Continued)

OTHER PUBLICATIONS

International Search Report mailed on Oct. 25, 2013 for PCT Patent Application No. PCT/EP2013055462, 4 pages.

*Primary Examiner* — Ted Kavanaugh
(74) *Attorney, Agent, or Firm* — Kilpatrick Townsend & Stockton, LLP

(57) ABSTRACT

A footwear (10) comprises an upper arrangement (20) and a sole (30), in which the upper arrangement (20) comprises an upper material (12) comprising in a lower peripheral area at least one air permeable portion (14), an air-permeable layer (16) arranged in a lower area of the upper arrangement (20) on the sole side above the sole (30), wherein the air-permeable layer (16) is water vapor permeable and has a three-dimensional structure that permits passage of air at least in the horizontal direction; and at least one water vapor permeable functional layer (18) arranged on an inner side of the upper material (12) and above the air-permeable layer (16). The at least one air permeable portion (14) enables the air permeable layer (16) to communicate with the outer surroundings such that air is exchanged between the outer
(Continued)

Figure 1:
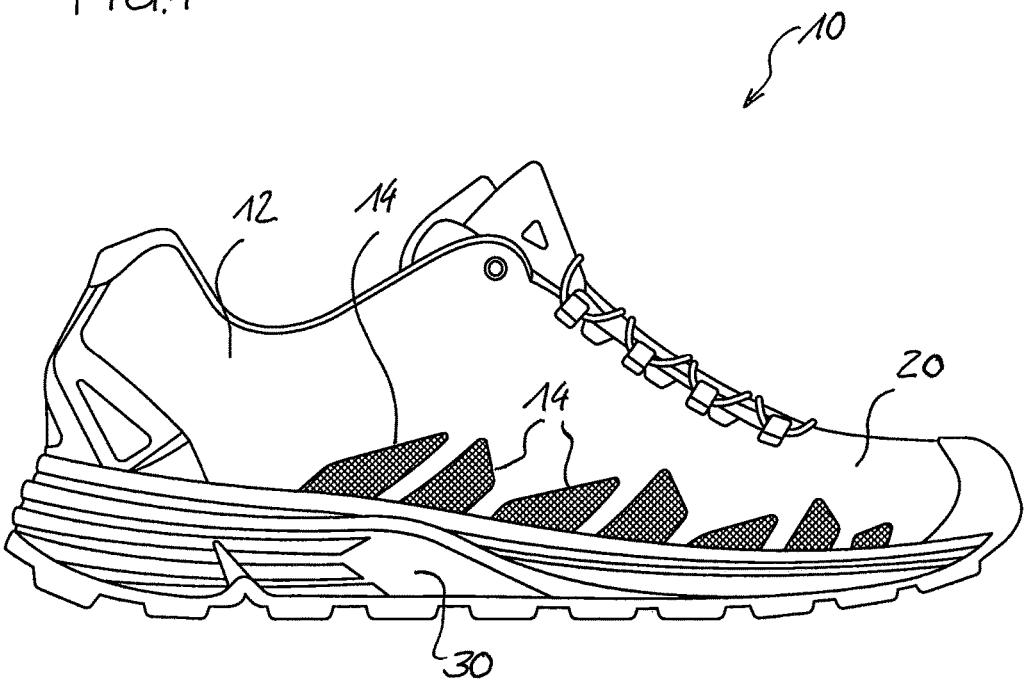

surroundings and the air permeable layer (16), said air permeable portion (14) further enables the water vapor permeable functional layer (18) to communicate with the outer surroundings such that water vapor is transported from an inner side of the functional layer (18) to the outer surroundings. A water vapor permeable first protective layer (22) is arranged between the air permeable portion (14) and the functional layer (18) in at least an area of the air permeable portion (14) above the air-permeable layer (16), wherein the first protective layer (22) is adapted for protecting the functional layer (18) against particles penetrating through the air permeable portion (14).

17 Claims, 7 Drawing Sheets

(58) Field of Classification Search
USPC ..... 36/3 R, 3 A, 3 B
See application file for complete search history.

(56) References Cited

U.S. PATENT DOCUMENTS 3,012,342 A * 12/1961 Ramirez ..... A43B 7/06 36/3 B
4,835,883 A * 6/1989 Tetrault ..... A43B 7/081 36/147
5,746,013 A 5/1998 Fay, Sr.
6,508,015 B1 * 1/2003 Rauch ..... A43B 7/06 36/3 B
6,655,048 B2 * 12/2003 Moretti ..... A43B 7/125 36/29
6,948,260 B2 * 9/2005 Lin ..... A43B 7/081 36/3 B
2001/0000272 A1 4/2001 Attilieni
2001/0003875 A1 * 6/2001 Moretti ..... A43B 7/08 36/3 B
2004/0049942 A1 3/2004 Chen
2011/0162239 A1 * 7/2011 Bier ..... A43B 1/04 36/3 B
2011/0167677 A1 7/2011 Peikert et al.
2012/0297644 A1 * 11/2012 Polegato Moretti ..... A43B 7/08 36/84
2015/0113836 A1 * 4/2015 Polegato Moretti ... A43B 7/085 36/3 A
2016/0000176 A1 * 1/2016 Peikert ..... A43B 7/085 36/3 A

FOREIGN PATENT DOCUMENTS

DE 90 16 134 U1 2/1991
EP 0 382 904 A2 8/1990
EP 0 479 183 B1 7/1996
EP 1 074 193 A1 2/2001

* cited by examiner

FOOTWEAR WITH AIR PERMEABLE LAYER AND AIR PERMEABLE PORTION IN A LOWER PERIPHERAL AREA OF THE UPPER ARRANGEMENT

This application is national stage application of PCT/EP2013/055462, filed on Mar. 15, 2013, the entirety of which is incorporated herein by reference.

The present invention is related to footwear comprising an upper arrangement and a sole, in which the upper arrangement comprises an upper material comprising in a lower peripheral area at least one air permeable portion, an air-permeable layer arranged in a lower area of the upper arrangement on the sole side above the sole, wherein the air-permeable layer is water vapor permeable and has a three-dimensional structure that permits passage of air at least in the horizontal direction, and at least one water vapor permeable functional layer arranged on an inner side of the upper material and above the air-permeable layer on the sole side. More specifically, the present invention describes embodiments of footwear with ventilation beneath the foot sole and with the removal of water vapor through layers beneath the foot to improve the climate comfort of such footwear.

In earlier times, shoes had either a certain water vapor permeability in the sole area, also called breathability, as a result of the use of a shoe sole material such as leather, with the drawback of water permeability in the sole area, or shoes were waterproof and water vapour impermeable in the sole area as a result of the use of outsoles made of a waterproof material, such as rubber or a rubber-like plastic, with the drawback that moisture could accumulate in the foot sole area.

In more recent times, shoes that are waterproof and also water vapor permeable in the foot sole area have been created by perforating their soles with through-holes and covering the through-holes with a waterproof, water vapor-permeable membrane, so that no water can penetrate into the shoe interior from the outside, but moisture that forms in the foot sole area can escape outward from the shoe interior. Two different solutions have been pursued here. Either the sole has been provided with vertical through-holes through which water vapor can be guided from the shoe interior to the walking surface of the sole, or the sole has been provided with horizontal channels through which water vapor that has accumulated above the outsole can escape through the side periphery of the sole.

Examples of the first solution, in which the sole has vertical through-holes are shown in, e.g., EP 0 382 904 A1. Examples of the second solution, in which the sole has horizontal ventilation channels running parallel to its walking surface, are known from, e.g., EP 0 479 183 B1.

US 2011/0167677 A1 discloses a shoe which has a ventilation space beneath the foot sole defined by an air-permeable spacer structure, which permits an efficient transport of water vapor to the outside of the shoe. Particularly, an embodiment of the shoe has an upper arrangement and a sole, the upper arrangement having an outer upper material and an air-permeable layer arranged in a lower region of the upper arrangement on the sole side above the sole. The air-permeable layer has a three-dimensional structure that permits air passage in at least the horizontal direction. The outer upper material has at least one air passage opening in a lower peripheral area on the sole side, by means of which a connection can be produced between the air-permeable layer and the outer environment of the shoe, such that air exchange between the outer environment and the air-permeable layer can occur. In this way, heat and water vapor can be removed from the area of the upper arrangement situated above the air-permeable layer, for example, by means of convective air exchange through the air-permeable layer.

In the region of the air passage openings, the upper material ends at a spacing above the air-permeable layer where it is lengthened with a connection material, which is connected to the upper material by means of a seam and which is embodied as air-permeable in order to permit air exchange between a peripheral side surface of the air-permeable layer and the outside of the footwear at the level of the air-permeable layer.

In an embodiment of such shoe, an upper lining laminate with a waterproof and water vapor permeable upper functional layer and an upper bottom laminate with a waterproof and water vapor permeable upper bottom functional layer are provided in the upper arrangement, so that water vapor permeability with simultaneous waterproofness is achieved, both for the upper and for the upper bottom area of the shoe.

Since the at least one air passage opening in this solution is not formed in the outsole, where it cannot be particularly large from the standpoint of outsole stability, but in a lower peripheral area of the outer upper material on the sole side, a situation is already achieved for increased air exchange and therefore a greater water vapor removal capability.

However, there may be a need to further enhance air exchange capability and water vapor removal capability of the footwear.

According to an aspect of the invention, there is provided footwear, comprising an upper arrangement and a sole, in which the upper arrangement comprises an upper material comprising in a lower peripheral area at least one air permeable portion, an air-permeable layer arranged in a lower area of the upper arrangement on the sole side above the sole, wherein the air-permeable layer is water vapor permeable and has a three-dimensional structure that permits passage of air at least in the horizontal direction; and at least one water vapor permeable functional layer arranged on an inner side of the upper material and above the air-permeable layer. The at least one air permeable portion enables the air permeable layer to communicate with the outer surroundings such that air is exchanged between the outer surroundings and the air permeable layer, said air permeable portion further enables the water vapor permeable functional layer to communicate with the outer surroundings such that water vapor is transported from an inner side of the functional layer to the outer surroundings. A water vapor permeable first protective layer is arranged between said at least one air permeable portion and said functional layer in at least an area of the at least one air permeable portion above the air-permeable layer, wherein the first protective layer is adapted for protecting the functional layer against particles penetrating through the air permeable portion.

Since the at least one air permeable portion enables the air permeable layer to communicate with the outer surroundings such that air is exchanged between the outer surroundings and the air permeable layer, and the air permeable portion further enables the water vapor permeable functional layer to communicate with the outer surroundings such that water vapor is transported from an inner side of the functional layer to the outer surroundings, air exchange capability and water vapor removal capability of the footwear can be improved as a result of an increased area in the upper arrangement for air exchange and water vapor removal. At the same time, with the provision of the first protective layer arranged between the air permeable portion and the functional layer above the air-permeable layer, the functional layer, which typically comprises a delicate membrane, despite the increased area in the upper arrangement for air exchange and water vapor removal, is protected against penetration of particles which may penetrate through the air permeable portion.

According to an embodiment of the invention, the at least one air permeable portion comprises at least one air passage opening in the upper material, wherein the air passage opening comprises an air permeable second protective layer. With the provision of an air passage opening in the upper material, the area for air exchange and water vapor removal in the upper material may be significantly increased, at the same time the second protective layer may be chosen such as to effectively protect the layers arranged behind, in particular the functional layer, from external impacts, such as larger particles in form of stones, etc.

The at least one air passage opening is in comparison to the prior art relatively large, for example, the at least one air passage opening above the bottom of the air permeable layer has a total area of at least 500 $mm^2$, preferably of at least 1000 $mm^2$, more preferably of at least 1500 $mm^2$, more preferably of at least 2000 $mm^2$. Particularly, in a practical example, it is preferred that the total area of the at least one opening is at least 3000 $mm^2$. In case of multiple air passage openings, the total area encompasses the sum of the areas of the individual air passage openings.

According to an embodiment, the second protective layer has an air permeability of at least 100 $l/m^2/sec$ at 100 Pa pressure difference. Particularly, in a practical example, it has an air permeability of at least 1800 $l/m^2/sec$ at 100 Pa pressure difference. For example, the second protective layer has a net-like structure and is adapted to have protective function against particles, particularly stones.

According to another embodiment, the at least one air permeable portion is formed of at least one air permeable material. For example, the air permeable portion may be formed of a material which is the same or similar as the upper material. For instance, the upper material and the air permeable portion may each comprise a net-like structure, e.g. in an implementation of the footwear as a sports shoe requiring high air permeability. According to a further embodiment, the upper material may comprises conventional upper material, like textile or leather and high air permeable upper material, wherein the air permeable material is forming the air permeable portion.

According to an embodiment of the invention, the first protective layer is chosen from a group of water vapour permeable materials consisting of: woven, nonwoven, felt, knit, porous material, non porous materials, foam and mesh-like material or combinations thereof.

Increased footwear breathability based on the combination of the air permeable layer and air permeable portion in the upper material, which due to its size expose a larger area of the functional layer to the outside and therefore increases breathability of the whole footwear.

In various embodiments, at least a part of a lower area of the air permeable portion is fastened by glue lasting to the bottom of the air-permeable layer. In this embodiment, the air-permeable layer also functions as a lasting or assembly insole, to which the air permeable portion and the upper material is fastened, for closing the upper arrangement.

According to a further embodiment, the upper arrangement comprises an insole element arranged below the air permeable layer and in one embodiment also assembled to a lower area of the air permeable portion, for example with glue. At least one of the lower peripheral area of the upper material is assembled to the insole element. For example, the lower peripheral area of the upper material is fastened by glue lasting to the bottom of the insole element which functions as an assembly insole positioned beneath the air-permeable layer.

In another variant the upper may be fastened by glue lasting below the air permeable layer. Also, many other ways to fasten the upper and/or the air permeable portion are possible, such as, but not limited to Strobel, another way that is used in the shoe making industry.

In a variant of the invention, the first protective layer is arranged in a lower area of the upper arrangement above the sole. For example, the first protective layer is arranged between the water vapor permeable functional layer and the air-permeable layer. Thus, the first protective layer is arranged on the sole side of the upper arrangement facing the air-permeable layer and in the peripheral regions above the air-permeable layer in the area of the air permeable portion. For example, the first protective layer is provided with attaching means, particularly adhesive in discontinuous distribution, on an inner and outer surface of the first protective layer.

The first protective layer may be arranged such that it covers at least the majority of the lower surface of the functional layer. The first protective layer may also extend at least laterally upwards extending into the area of the air permeable portion. The first protective layer may also completely or partially cover a sealing area between an upper functional layer and an upper bottom functional layer and even may go beyond covering parts of the upper functional layer in the lower region of the upper. The first protective layer advantageously protects the functional layer against external or internal influences or impacts when wearing the shoe.

According to another embodiment, the first protective layer extends only in a peripheral area of the upper arrangement. Thus, the first protective layer is arranged only in peripheral regions above the air-permeable layer in the area of the air permeable portion. For example, the first protective layer is provided with attaching means, particularly adhesive in discontinuous distribution, on an inner surface of the first protective layer.

According to an embodiment of the invention, the first protective layer is different from the second protective layer.

Preferably, the first protective layer has a water vapor permeability (MVTR) of at least 4 $mg/cm^2/h$.

The first protective layer is particularly adapted to protect the functional layer against dust, small particles and abrasion, and/or puncture damage. This ensures long time usability of the footwear since a delicate membrane comprised in the functional layer is protected against external influences which may penetrate or act through the air permeable portion.

In a variant of the invention, the upper arrangement comprises at least one particle barrier layer arranged between the at least one air permeable portion and the functional layer at a level above the air-permeable layer.

For example, such particle barrier layer, which may be air impermeable, provides additional protection in that it prevents larger or smaller particles such as stones, dirt, etc. to accumulate in a space between the functional layer and the upper material and/or air-permeable layer. The particle barrier layer may be located at a level right above the air permeable layer, but may also be located higher relative to the air permeable layer in the direction of the upper material. Thus, the potential risk of damaging the functional layer by such particles is reduced.

For example, the particle barrier layer may have the form of a strip. It may be arranged longitudinally along at least parts of the circumference, particularly where the air permeable portion is arranged, or along substantially the whole circumference of the shoe. It may cover and/or may be arranged in regions above the air permeable layer in a circumferential region of the shoe between the horizontal bottom and the vertical part of the upper arrangement, where the shoe may come into contact with stones or other particles in a vertical movement when stepping onto the ground. The particle barrier layer may be attached to the first protective layer.

For example, the particle barrier layer is arranged so as to contact an inside surface of the air permeable portion. For instance, the air permeable portion presses the particle barrier layer in the direction of the first protective layer.

The functional layer may be an upper functional layer and/or an upper bottom functional layer, particularly extending from below the foot to regions upwards to the sides of the upper arrangement. As one example, an upper functional layer and upper bottom functional layer may be connected with each other to form a sock-like functional layer arrangement. There may be other variations on the process of how the functional layer is made part of the upper assembly.

In various embodiments, the footwear comprises a water vapor permeable upper functional layer arranged in an upper area of the upper arrangement and a water vapor permeable upper bottom functional layer arranged in a bottom area of the upper arrangement. These two functional layers can be identical or even actually can be distinctively different materials.

According to an embodiment of the invention, the footwear comprises a sock-like functional layer bootie which comprises the at least one functional layer. In such sock-like functional layer bootie an upper area is formed at least partially by an upper functional layer and a bottom area is formed by an upper bottom functional layer. Such a bootie is usually stitched together from several functional layer parts, wherein the stitching sites are glued over with a watertight seam-sealing strip and made watertight in this way.

In various embodiments, the air-permeable layer is situated beneath the upper bottom functional layer.

In various embodiments, the at least one functional layer is waterproof.

Figure 2:
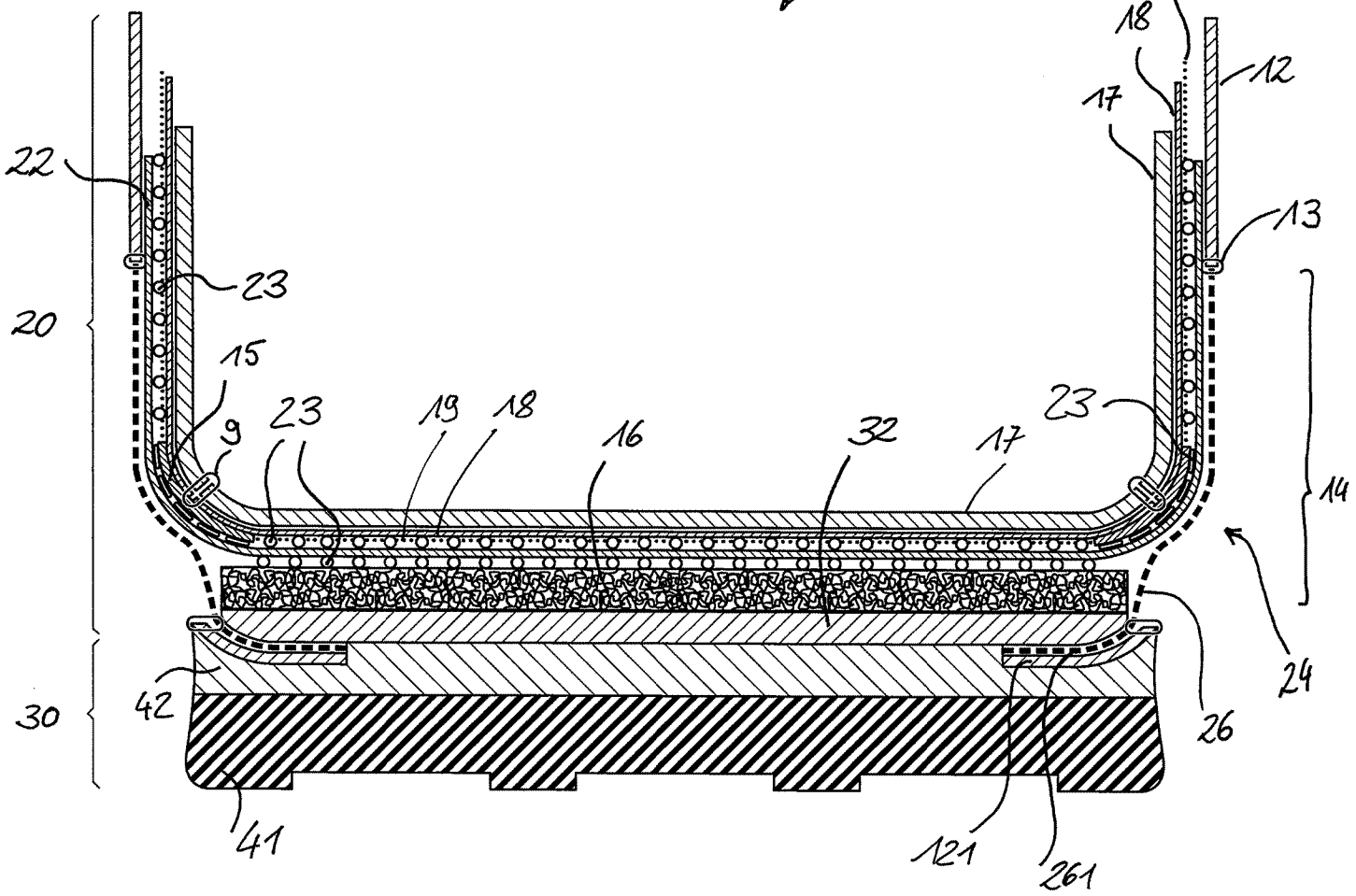
Figure 3:
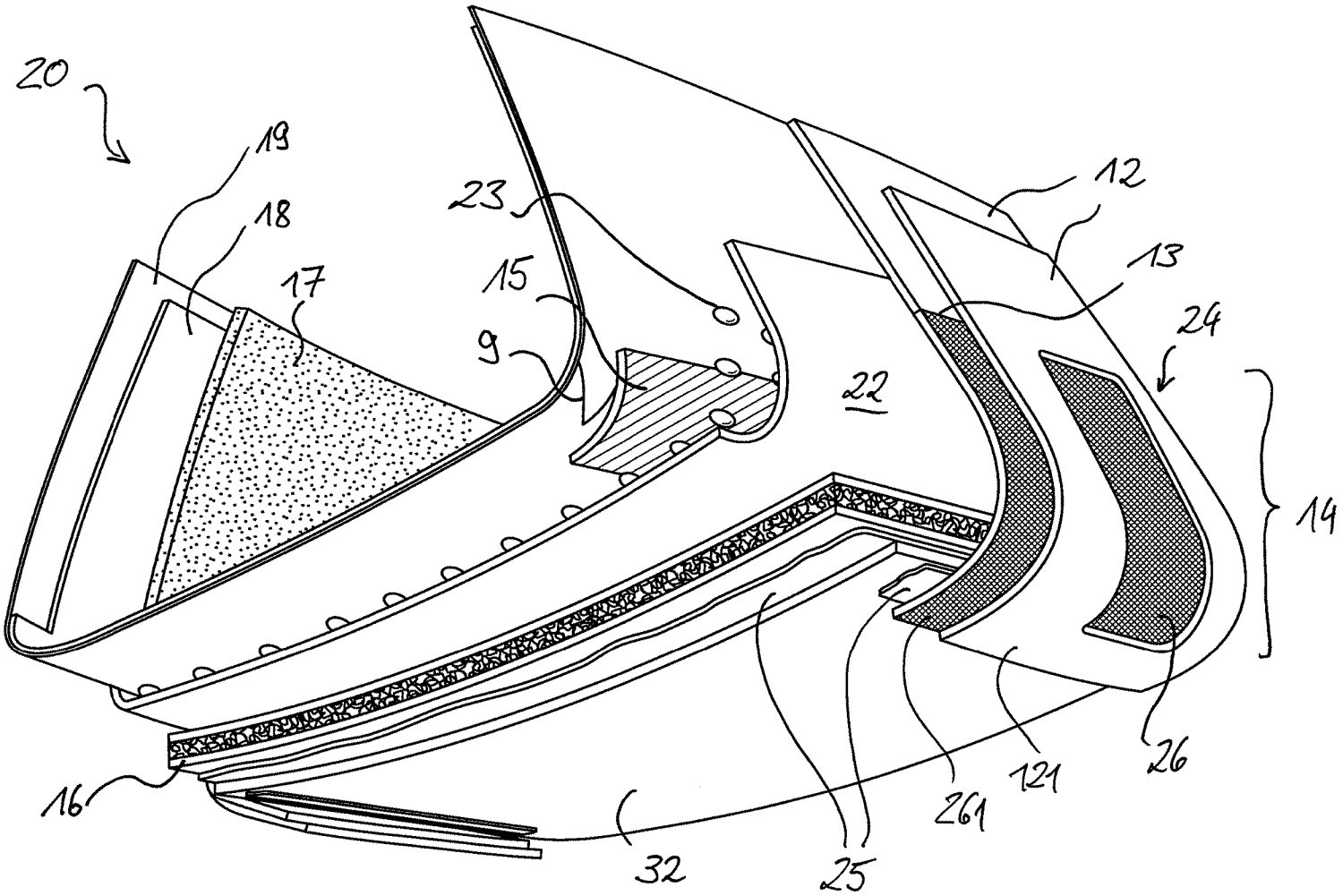
Figure 4:
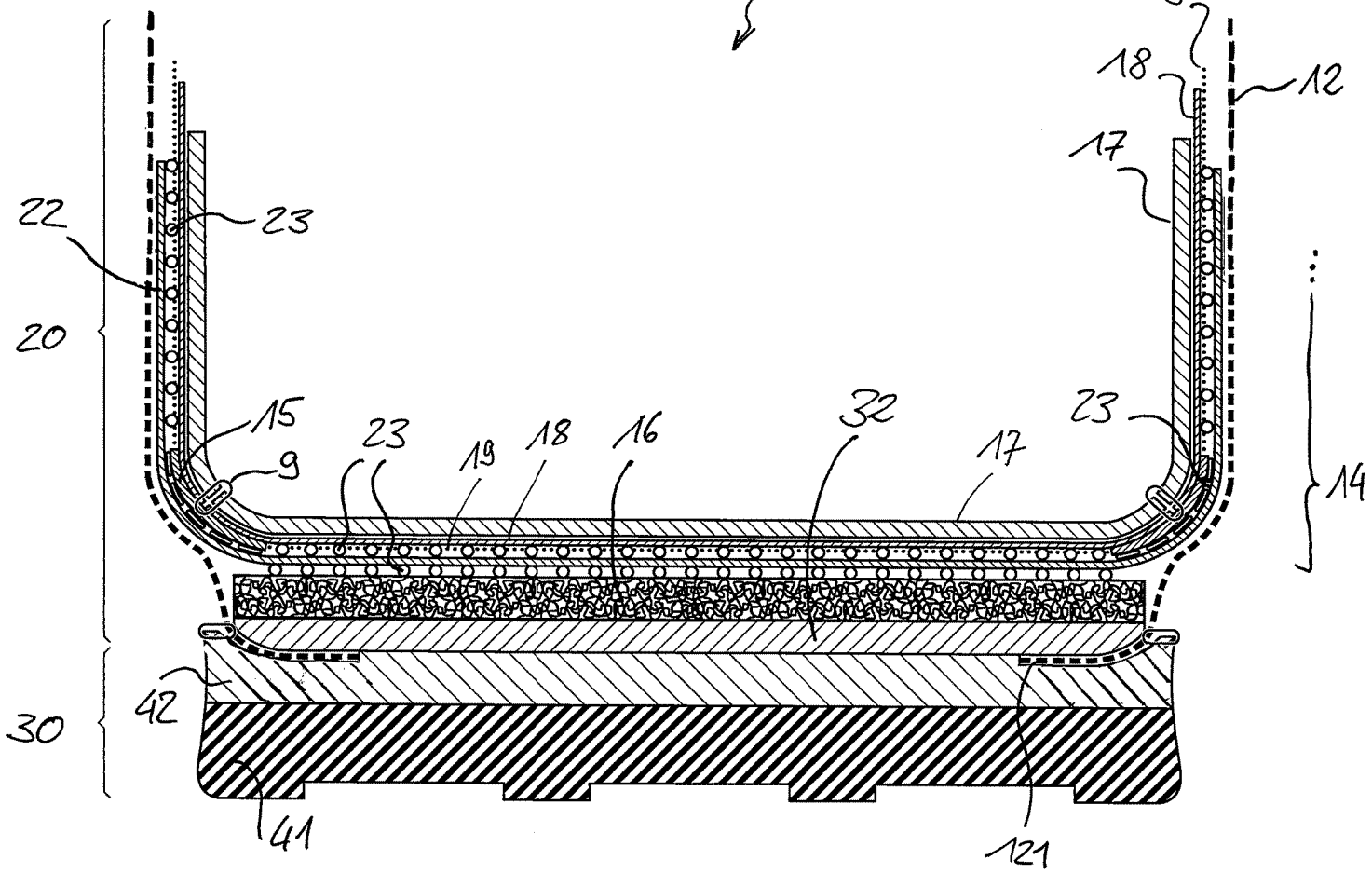
Figure 5:
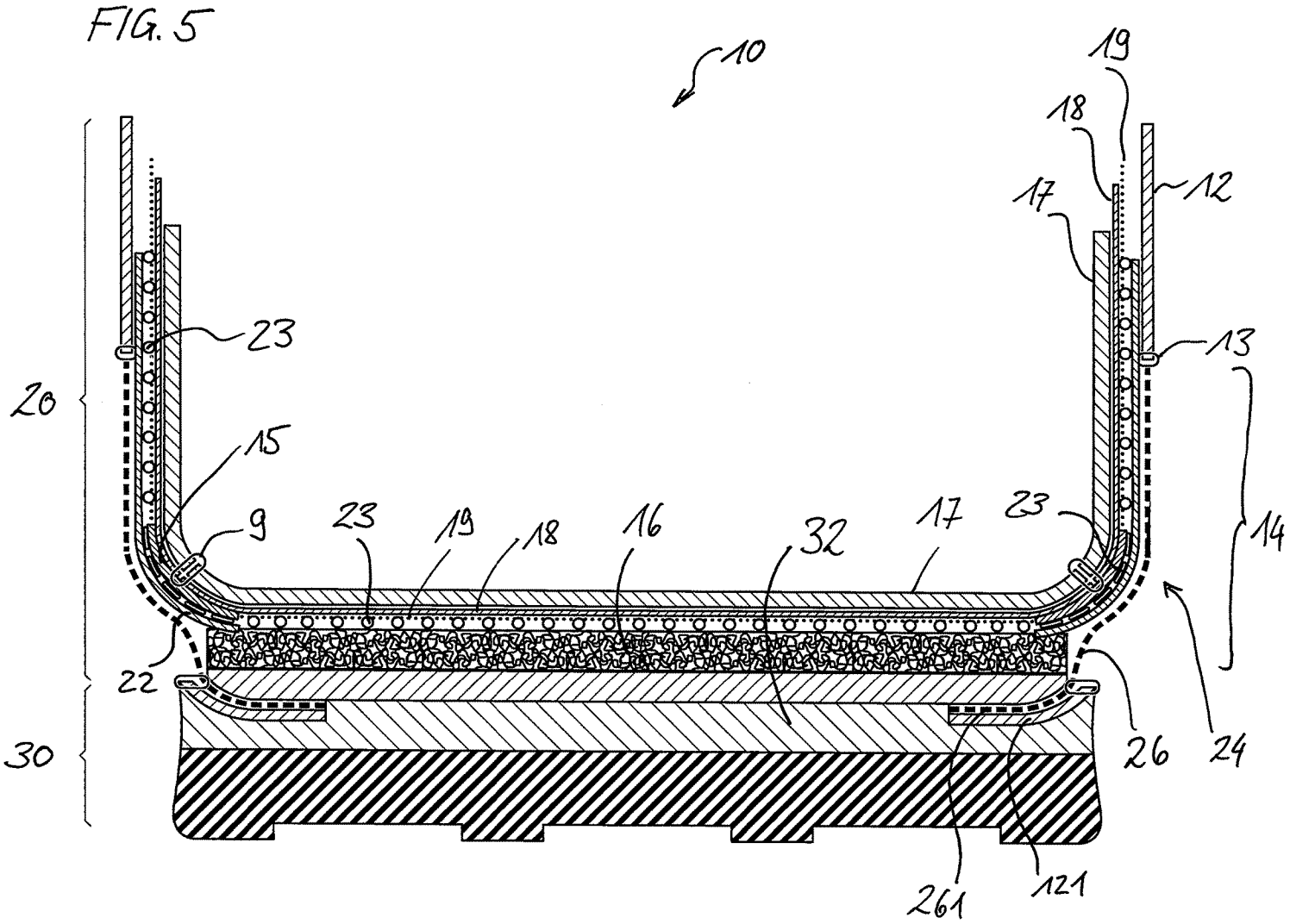
Figure 6:
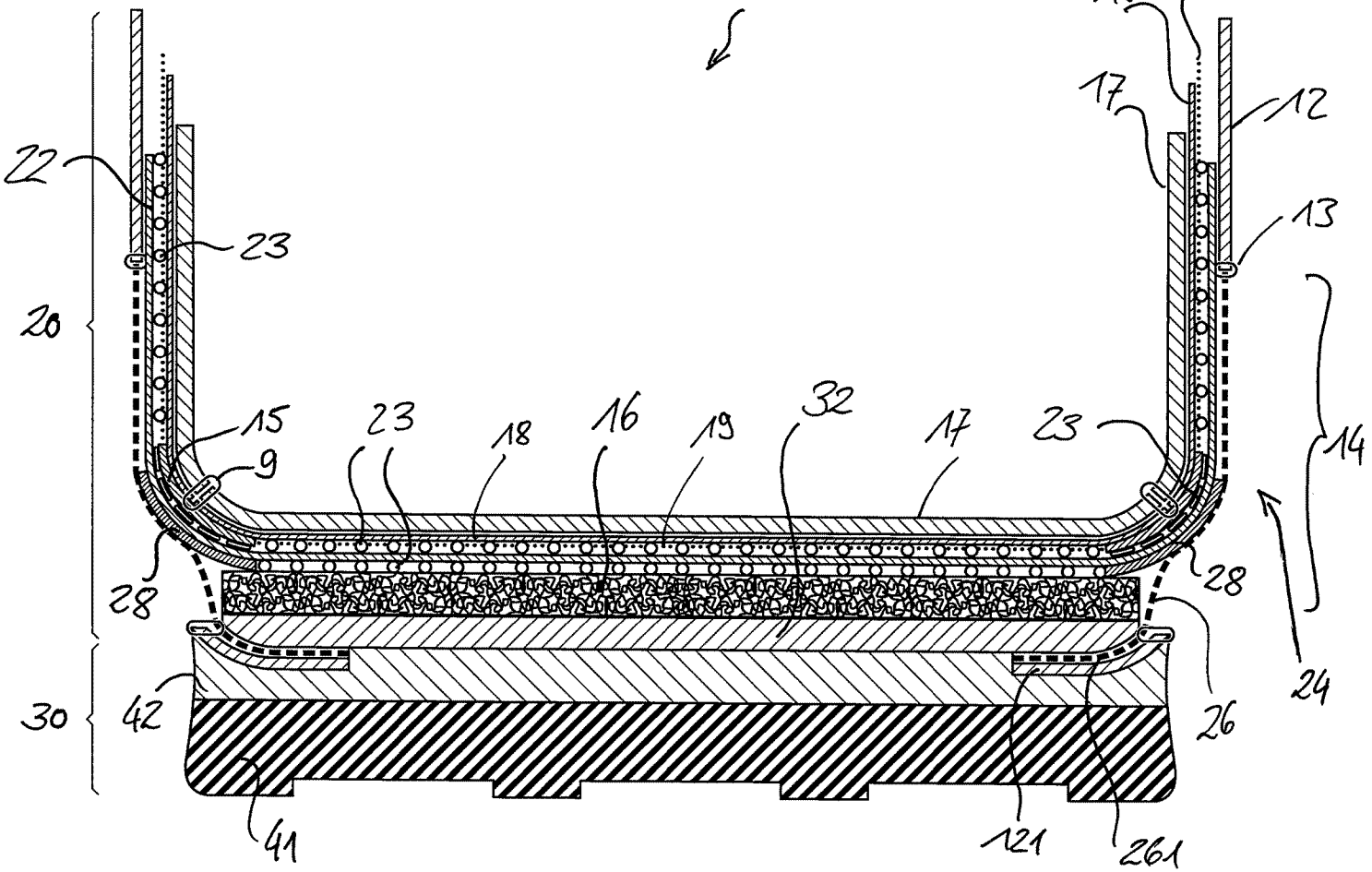
Figure 7:
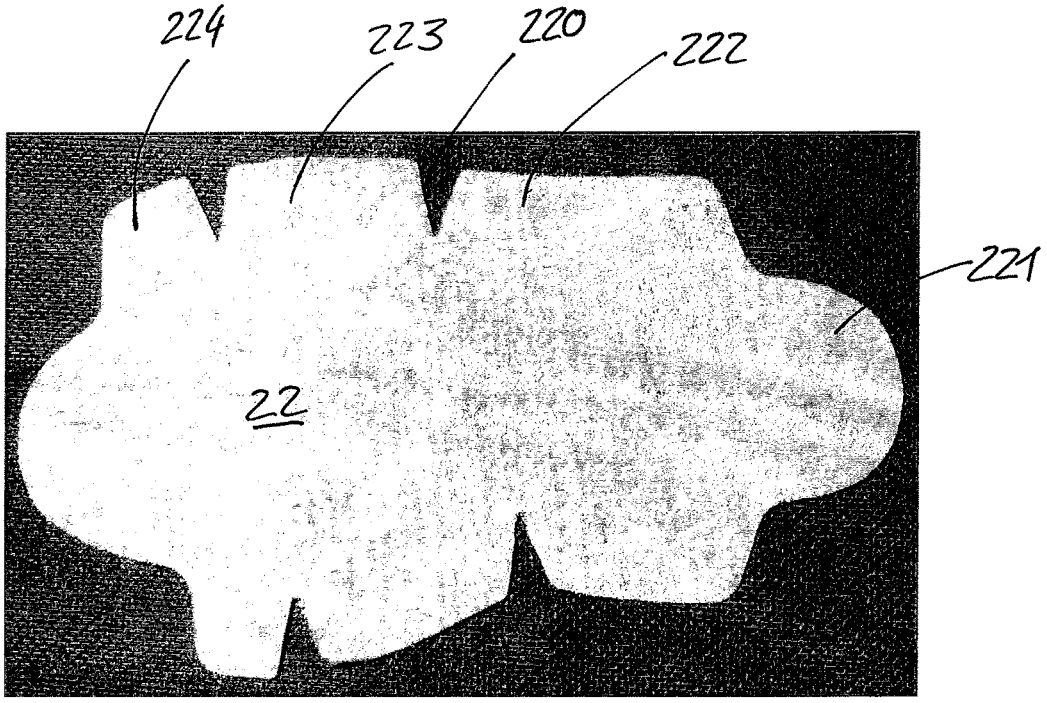

Further embodiments and aspects of the invention are described in the following description with reference to the drawings. The invention will now be further explained by means of variants, wherein in the enclosed drawings:

FIG. 1 shows a side view of an embodiment of footwear with several air permeable portions in the upper material;

FIG. 2 shows an embodiment of footwear according to the invention in a cross-sectional view, FIG. 3 shows parts of the embodiment of FIG. 2 in a perspective, three-dimensional view, FIG. 4 shows another embodiment of footwear according to the invention in a cross-sectional view, FIG. 5 shows a further embodiment of footwear according to the invention in a cross-sectional view, FIG. 6 shows yet a further embodiment of footwear according to the invention in a cross-sectional view, FIG. 7 shows an exemplary embodiment of a design of the first protective layer in a top view.

FIG. 1 shows an embodiment of footwear in the form of a shoe 10. It has an upper arrangement 20 and a sole 30 applied to the lower end area of the upper arrangement 20. The upper arrangement 20, in the usual manner, has a foot-insertion opening, from which a lace area extends in the direction of the forefoot area of the upper arrangement. In the lower area of the upper arrangement 20, a number of air permeable portions 14 are arranged around part of the periphery of the upper arrangement 20. In the front part of the forefoot area, which corresponds roughly to the toe area of the shoe, and in the heel part no air permeable portions 14 are provided in this embodiment. The air permeable portions 14 are, in this embodiment, distributed around the remaining peripheral area of the upper arrangement 20, with roughly the same spacing, and are formed in any suitable shape.

FIGS. 2 and 3 show an exemplary footwear according to an embodiment of the invention in a cross-sectional view. Particularly, FIG. 2 shows an upper arrangement 20 and a sole 30 applied to it which comprises an outsole or tread 41 and a midsole 42. The sole 30 may be provided as a composite sole, as shown, or may be provided as one material piece. An attachment of the sole 30 to the upper arrangement 20 may be made through cementing the sole 30 to the upper arrangement 20. The shoe may also be manufactured by attaching the sole 30 to the upper arrangement 20 by injection molding or any other way of attaching the sole to the upper. The material of the sole 30 is waterproof and typically impermeable to water vapor and may be al kinds of plastics material including all kinds of rubber, foamed material, cured and thermoplastic materials as all as natural materials like leather or others commonly used for forming soles and any layers thereof.

The upper arrangement 20 has an upper material 12, on the inside of which a first layer composite material is situated. For example, as a first layer composite material a laminate is provided (in the following also referred to as "first laminate") which comprises (from inside to outside): an upper lining textile layer 17 which is water vapour permeable but not waterproof, a functional layer 18 which may have the form of a membrane and a supporting layer 19 for the functional layer 18 having a supporting mesh structure (e.g. nylon) that is water vapor permeable and allows penetration of adhesive. The functional layer 18 is preferably waterproof and water vapor permeable, such as an ePTFE (expanded polytetrafluorethylene) membrane or an PU (polyurethane) membrane, The functional layer 18 may have a porous structure and may be a multilayer product, such as a ePTFE layer plus PU coating or ePTFE layer with surface treatment. The first laminate formed by layers 17, 18 and 19 may cover mainly the whole of the top and sides of the foot.

The functional layer is not limited to the above mentioned execution but can also consist of more or also less layers, other membranes, and also other alternative solutions to membranes achieving the same result for the shoe. This also includes other ways to integrate membranes, as well as treatments like Plasma Durable Water Repellent ("DWR") treatments or and other alternative solutions to render the shoe waterproof while being breathable and allowing for air passages as described above.

The upper material 12 may be water vapor permeable and may be made, e.g., of leather, polyamide or other material, or combinations of these. It is the visible, outer part of the upper arrangement. The upper material 12 surrounds the first laminate with layers 17, 18, 19, wherein the upper material and the first laminate are basically of the same shape to be able to receive a foot. The upper material 12 and the first laminate are attached to each other where needed, in a manner that maintains the waterproof and water vapor permeable properties of the combination of upper material and first laminate.

According to the embodiment of FIGS. 2 and 3, there is further provided a second layer composite material in the bottom area of the upper arrangement 20. For example, as a second layer composite material a laminate is provided (in the following also referred to as "second laminate") which comprises basically the same layer structure as the first laminate (from the inside to the outside): a bottom lining textile layer 17 which is water vapour permeable but not waterproof, a preferably waterproof and water vapor permeable functional layer 18, such as an ePTFE membrane or composite membrane, and a supporting layer 19 for the functional layer 18, such as a supporting mesh structure (e.g. nylon).

The lower end of the first laminate and the circumferential edge of the second laminate are attached to each other by at least one seam 9, such as a Strobel seam or similar. This at least one seam 9 is sealed in a waterproof manner using a seam tape 15 which is applied on the side of the seam facing away from the foot, e.g. by using a special seam sealing machine. The finished lining construction formed by the first laminate and second laminate as part of the upper arrangement 20 is a waterproof sock-like construction, also known as functional layer bootie.

Such a bootie is usually stitched together from several laminate parts, wherein the stitching sites are glued over with a waterproof seam-sealing strip and made waterproof in this way. The upper arrangement 20 is therefore waterproof and water vapor permeable, and after addition of a sole 30, a waterproof and water vapor permeable shoe 10 is provided.

Generally, the upper part and the bottom part of functional layer 18 can be common parts of a functional layer bootie, or they can be separate functional layer parts that are sealed with respect to one another. The upper and bottom parts of functional layer 18 each may be part of a multilayer functional layer laminate, as described above, such as a three-layer functional layer laminate with a functional layer which is embedded between two textiles. The textiles can usually be one textile layer each.

In various embodiments, the functional layer may be integrated in any other form or way applicable for such footwear products.

As further shown in FIGS. 2 and 3, an at least air-permeable layer 16 (which may also have other functions), which is water vapor permeable in the direction towards the bottom part of the functional layer 18, is arranged in a lower area of the upper arrangement 20 above the sole 30. The air-permeable layer 16 has a structure that permits air passage at least in the horizontal direction. Particularly, the air-permeable layer 16 is situated beneath the bottom part of functional layer 18. The lower end area of the upper material 12 on the sole side is glue-lasted or attached as a lasted end 121 by means of lasting adhesive 25 (shown in FIG. 3) on the bottom of the insole element 32 serving as an assembly insole. The insole element 32 is glued by adhesive 25 to the underside of the air-permeable layer 16.

In one particular embodiment, an insole is positioned below the second laminate, particularly below the air permeable layer. It may have the constitution of an assembly or lasting insole to which the end portions of the upper material and air permeable portion are folded and fixed on its underside for closing the upper arrangement when fitted on a last, before a sole is attached to the underside of the closed upper arrangement. The insole and the lower surface of the air permeable layer are fixed to each other by gluing, such as lasting glue, or equivalent. The insole can be made of various types of materials depending on desired stiffness, hardness or other properties. In an embodiment, the insole is made of 100% Polyamide with a layer of 20 g nonwoven and is non breathable. The insole may have a total thickness of 2.2 mm in the toe area and 4.0 mm in the heel area and is commercially available from the company Stilflex, Limena, Italy. The insole can also have other functions like puncture protection for safety shoes. Also, the insole may be very soft and attached by means other than adhesive, like stitching (as it is used in common Strobel constructions).

In an alternative embodiment (not shown), in which there is no separate insole element 32, the air-permeable layer 16 may also act as a lasting insole to which the lasting margin 121 of the upper material 12 being attached by lasting adhesive. Instead of using a separate insole 32, it is also possible in certain variants to make the bottom or lower support surface of the air-permeable layer 16 correspondingly stable as needed, so that the lasting margin 121 can be attached to this bottom. In such an embodiment, the air-permeable layer 16 may additionally assumes the function of an insole.

In another embodiment (not shown), the lower end area of the upper material 12 on the sole side may be connected by means of a stitched seam (such as a Strobel seam) to an insole. Other ways to integrate the air permeable layer into the lower region of the upper assembly may also be used.

As further shown in FIGS. 1, 2 and 3, the upper material 12 comprises in a lower peripheral area air permeable portions 14, one of which on each side is shown in the depictions of FIGS. 2 and 3. Generally, each of the air permeable portions 14 enables the air permeable layer 16 to communicate with the outer surroundings such that air is exchanged between the outer surroundings and the air permeable layer 16. Further, each of the air permeable portions 14 further enables the water vapor permeable functional layer 18 to communicate with the outer surroundings such that water vapor is transported from an inner side (i.e., the side facing the foot) of the functional layer 18 to the outer surroundings.

According to the embodiment of FIGS. 2 and 3, each of the air permeable portions 14 comprises at least one air passage opening 24 formed in the upper material 12. The air passage opening 24 comprises an air permeable second protective layer 26 which covers the air passage opening 24. For example, the second protective layer 26 may be connected to the upper material 12 by a stitching 13. In the region of the air passage opening 24, the upper material 12 is replaced with the second protective layer 26. In the depiction of FIG. 3, a lower part of upper material 12, which comprises the air passage opening 24, is applied over the second protective layer 26 and is attached to an upper part of upper material 12. Like the lasting margin 121 of the upper material 12, the second protective layer 26 comprises a lasting margin 261 which is attached by lasting adhesive 25 (FIG. 3) to the underside of insole element 32. The lasting adhesive 25 may penetrate through the second protective layer 26, so as to also attach the lasted end 121 of the upper material 12.

The second protective layer 26 is formed, for example, by a gauze or mesh made of a textile material with high air permeability and therefore also high water vapor permeability. The second protective layer 26 can be situated on the outside or inside of the corresponding air passage opening 26. Each air passage opening 26 may have its protective layer 26 applied to it. In other embodiments, the second protective layer may be applied as common protective covering strip to some or all of the air passage openings 26, so that the protective covering strip extends over the corresponding number of air passage openings 26. The protective covering strip can also become at least part of the lasting margin.

In an embodiment of the invention, the one or more air passage openings 24 have a total area of at least 500 $mm^2$, preferably of at least 1000 $mm^2$, more preferably of at least 1500 $mm^2$, more preferably of at least 2000 $mm^2$, more preferably of at least 3000 $mm^2$. Preferably, the second protective layer 26 has an air permeability of at least 100 $l/m^2/sec$ at 100 Pa pressure difference. In a particular implementation, the second protective layer 26 has a net-like structure and is adapted to have protective function against entry of larger particles, like stones. In this way, high water vapor permeability may be combined with suitable protective function against external impacts and stabilizing function.

As further shown in FIGS. 2 and 3, a water vapor permeable and preferably water repellent first protective layer 22 is arranged between each of the air permeable portions 14 and the functional layer 18 in at least an area of the respective air permeable portion 14 above the air-permeable layer 16. The first protective layer 22 is adapted for protecting the functional layer 18 against particles, which may penetrate through the air permeable portion 14. Advantageously, the first protective layer 22 is chosen from a group of materials consisting of woven, nonwoven, felt, knit, porous materials, non porous materials, foam and mesh-like material or combinations thereof. In one embodiment the first protective layer 22 may be made of a non woven felt material which may be treated to become hydrophobic.

The first protective layer 22 is optionally associated to the second laminate in a way that breathability is maintained, for example using a discontinuous adhesive application. For example, the first protective layer 22 is optionally associated to the second laminate, i.e. to the upper bottom supporting layer, which may have the form of a mesh, and to the functional layer through the open structure of the layer by means of adhesive dots or particles maintaining breathability of the entire stack of materials.

In the embodiment of FIGS. 2 and 3, the first protective layer 22 also extends horizontally into the bottom area of the upper arrangement 20 facing the sole 30 and is situated between the water vapor permeable functional layer 18 and the air-permeable layer 16. Further, the first protective layer 22 is provided in this embodiment with adhesive 23 in discontinuous distribution, such as adhesive dots 23, on an inner and outer surface of the first protective layer 22.

The first protective layer may be arranged such that it covers at least the majority of the lower surface of the upper bottom functional layer facing towards the sole. The first protective layer may also extend at least partially laterally upwards around the edge of the last, at least extending into the area of the openings as shown. The first protective layer may also completely or partially cover the seam tape and even may go beyond it, covering at least parts of the lower end of the first laminate, particularly the upper functional layer in the air permeable portion. The first protective layer advantageously protects the upper bottom functional layer, which may be in the form of a membrane as set out above, against rubbing with the below arranged air permeable layer (set out in more detail below) as there may be a relative movement between air permeable layer and functional layer during walking, particularly if there are no adhesive dots provided. The first protective layer may also be of a constitution suitable for protecting the functional layer against external impacts acting directly or indirectly through the air permeable portion on the functional layer.

Preferably, the first protective layer 22 has a water vapor permeability (MVTR) of at least 4 $mg/cm^2/h$ measured according to ISO 14268 (March 2013). In a preferred embodiment, the first protective layer 22 has a MVTR of at least 25 $mg/cm^2/h$.

In one embodiment the first protective layer 22 may be formed by the supporting layer 19 of the laminate.

The primary function of the first protective layer 22 is to protect the functional layer 18 against particles which may penetrate through the air permeable portion 14, particularly against dust and small particles and also against abrasion which may act through the upper material 12 and the second protective layer.

In FIG. 4, there is shown another embodiment of footwear according to the invention in a cross-sectional view. The embodiment according to FIG. 4 is different from the embodiment according to FIGS. 2 and 3 in that one or more of the air permeable portions 14 are formed of at least one air permeable material. In the present embodiment, the air permeable portions 14 are formed at least partially by an air permeable upper material part 12. For example, such upper material part 12 has a net-like structure with open interspaces or voids which allow high air permeability. Nevertheless, such upper material 12 still provides protective function against particles, particularly stones, for the underlying layers, particularly the functional layer 18. For instance, said air permeable upper material parts 12 may have an air permeable net-like structure over its whole surface surrounding the foot insertion region above the sole or only over parts of its surface, particularly in the peripheral regions adjacent to and above the air permeable layer 16. In a particular embodiment, the upper material 12 may be formed from the same or similar material as the second protective layer 26 according to the embodiment of FIGS. 2 and 3.

In this embodiment, the upper material 12 forming the air permeable portions 14 preferably has an air permeability of at least 100 $l/m^2/sec$ at 100 Pa pressure difference at least in the regions of the air permeable portions.

The remainder of the components of the footwear according to the embodiment of FIG. 4 is the same as in the embodiment of FIGS. 2 and 3, so that it is referred to the corresponding description thereof above.

FIG. 5 shows a further embodiment of footwear according to the invention in a cross-sectional view. Again, the footwear is similar to the embodiment according to FIGS. 2 and 3. In a difference thereto, according to the embodiment of FIG. 5, the first protective layer 22 extends only in a peripheral area of the upper arrangement 20. In other words, the first protective layer 22 does not extend into the bottom area of the upper arrangement 20 facing the sole 30 between the bottom part of the functional layer 18 and the air-permeable layer 16, but extends only in a peripheral area of the upper arrangement 20. Advantageously, the first protective layer 22 is provided with attaching means 23, particularly adhesive in discontinuous distribution, on an inner surface of the first protective layer 22. As to the material for the first protective layer 22, the same material can be used as described above with reference to FIGS. 2 and 3.

As shown, the first protective layer 22 may extend into the bottom area of the upper arrangement 20 such that it touches only the peripheral edges of the top surface of the air permeable layer 16 closing a space between the bottom part of the functional layer 18 and the air permeable layer 16. As a result thereof, any particles penetrating through the air permeable portion 14 are prevented from entering between the bottom part of the functional layer 18 and the air permeable layer 16. In this region, the first protective layer 22 is preferably attached to the layer structure above, in the present example to the first laminate, the second laminate and/or the seam tape 15, particularly by the adhesive 23.

With reference to FIG. 6, there is shown a further embodiment of footwear according to the invention in a cross-sectional view. Again, components with same reference numerals as in the preceding embodiments are the same or similar as in these embodiments and are not described in detail herein again.

Further to the components as described above, the upper arrangement 20 of the footwear in this embodiment comprises a particle barrier layer 28 arranged between the respective air permeable portion 14 and the functional layer 18 at a level above the air-permeable layer 16. For example, it is located in the lateral quarter above the air permeable layer 16. For instance, the particle barrier layer 28 is attached to the first protective layer 22, e.g. by adhesive (not shown). On its other side, the particle barrier layer 28 may be arranged so as to contact an inside surface of the air permeable portion 14. For example, the second protective layer 26 or upper material 12, respectively, may be arranged such that the particle barrier layer 28 is pressed onto the surface of the first protective layer 22. In this way, the particle barrier layer 28 is held against the upper material 12 and/or the second protective layer 26 without any open space or gap in between.

According to an embodiment, the particle barrier layer 28 is impermeable to air. As such, it may be placed advantageously in the region of the seam tape 15 which is also impermeable to air, thus limiting the air impermeable regions only to the angled peripheral areas of the upper arrangement 20 directly above the air permeable layer 16.

In all embodiments, in order to achieve particularly effective air exchange between the inside of the footwear and the outer surroundings, the air permeable portions 14 have a vertical extension which is significantly greater than the vertical thickness of the air-permeable layer 16 and extends up into the vertical regions of the upper arrangement.

The one or more air permeable portions can be continuous (according to the principle as schematically shown in FIG. 4 of US 2011/0167677 A1 for the air passage openings 20 which are formed by an air-permeable material that extends around the entire periphery of the lower shaft area) or discontinuous, as shown in an example according to FIG. 1 herein. In the embodiment of at least one air passage opening comprising an air permeable second protective layer (FIGS. 2 and 3), the second protective layer 26 can be attached separately to each opening 24 or can be in the form of one material piece covering a number of openings 24 at the same time along the periphery of the upper arrangement. According to an embodiment, it may correspond to the connection material of US 2011/0167677 A1, depicted there with reference numeral 210.

The sole 30 can be constructed as a multilayer assembly or made of one material piece with waterproof material, in which rubber or a rubber-like elastic plastic, for example, an elastomer, is involved. The sole 30, however, can also consist of a water vapor-permeable material, such as leather. The sole 30 can be a prefabricated sole glued to the upper arrangement 20 or a sole molded onto the upper arrangement 20. A walking surface of this sole, situated on the bottom of the sole 30 and shown as tread 41, is provided in the usual manner with a groove pattern, in order to form profile protrusions that improve the antislip characteristics of the shoe.

The first protective layer 22 preferably is a durable and water vapor permeable layer that protects the functional layer (more particularly, the bootie laminate(s)) from abrasion and puncture damage. It is preferably also air permeable to increase the overall breathability. Advantageously, it is air permeable at least in the region facing the air permeable layer 16.

The first protective layer can be treated hydrophobic and/or oleophobic. It may be chosen from a group of materials comprising woven materials, nonwoven (felt) material, knits, porous/non porous material, foams, meshlike materials or combinations thereof. The first protective layer 22 may be chosen from a flexible material to adapt to the shape of the sock like bootie.

In one example, the first protective layer can be made of a non woven polyester material which has been hydrophobic treated using fluoropolymers. The first protective layer has a textile weight of ≥100 g/m$^2$, preferably of 120 g/m$^2$ and a water vapor permeability (MVTR) of >25 mg/cm$^2$/h according to DIN EN ISO 14268. Furthermore the first protective layer shows a Martindale Dry Abrasion is >5000 movements, according to ISO 12947.

In a particular example, the first protective layer is a water repellent 100% Polyester felt with a thickness of 0.5+/−0.1 mm and a weight of 110 g/m$^2$+/−10%, available by the company VELA TECHNOLOGIES S.r.l.

The first protective layer 22 is optionally attached to the functional layer laminates in a way that overall breathability is maintained, for example using a discontinuous adhesive application. For example, the first protective layer 22 is optionally attached by means of adhesive dots or particles not affecting the breathability of the layer arrangement.

FIG. 7 shows an exemplary embodiment of a design of the first protective layer 22 in a top view. In this embodiment, the first protective layer 22 has circumferential parts 221 to 224 which may be formed as a kind of wing shaped. Particularly, the circumferential parts 221 to 224 may be formed by respective notches 220 in the circumference of the first protective layer 22 delimiting the parts 221 to 224 from each other. Such forming of the first protective layer 22 may be advantageous for attaching the first protective layer 22 to the functional layer laminates (bootie) in a foldfree manner and to conform the first protective layer 22 to the shape of the laminates or bootie.

As for the air-permeable layer 16 (which also functions and may be designated as a "spacer material"), a material is chosen which provides a durable, highly air permeable region that connects the underfoot functional layer (bottom part of functional layer 18) and first protective layer 22 to the external environment.

For example, a hydrophobic water vapor permeable three dimensional textile material may be used for the air permeable layer 16. The air-permeable layer 16 acts as ventilation layer. Preferably, the air-permeable layer 16 is water vapor permeable in a vertical direction and in a horizontal direction. At least in a horizontal direction the air-permeable layer 16 allows a certain airflow due to its structure.

The lower surface of the air-permeable layer 16 may not be water vapor permeable. In the current embodiment the air-permeable layer 16 is air permeable and water vapor permeable in horizontal and vertical direction. The upper surface of the air-permeable layer 16 may be attached to a layer above, as described above, in a manner that still maintains the breathability of these layers using for example a discontinuous adhesive In a particular example, the air permeable layer 16 is made of a 100% PES material with a thickness of 6.5 mm, a weight of 980 g/m$^2$ and a width of 110 cm. available from the company Tylex (article No D0082_03).

The air-permeable layer 16 corresponds in principle to the shape of the insole element 32, if any.

The particle barrier layer 28 as used herein is preferably a protective boundary layer between the first protective layer 22 and the upper material, particularly located in the lateral quarter above the air permeable layer 16. The particle barrier layer 28 according to an embodiment is not permeable to air. It may be permeable to water vapor. The particle barrier layer 28 may be fixed to the lateral extensions of the seam tape 15 or any corresponding facing layer, e.g. by using adhesive, for example an adhesive tape or the same adhesive provided also over the remainder of the facing layer. This may be done in a breathable or non breathable manner. The particle barrier layer 28 may have the form of a strip, and may be arranged longitudinally along at least parts of the circumference of the footwear. It may be formed as a continuous strip or it may comprise multiple strips which are arranged along the peripheral extension of the footwear. It may cover and/or may be arranged in the angled peripheral regions of the upper arrangement 20 above the air permeable layer 16. For example, the particle barrier layer 16 is provided with attaching means, such as adhesive or adhesive tape, on an inner surface of the particle barrier layer, preferably only on the inner surface of the particle barrier layer.

For example, the particle barrier layer 28 is made of a material which has the following properties:

Material: closed cell foam (EVA (Ethylene vinyl acetate) and/or PE (polyethylene)

Provided with self adhesive hot melt on inner side,

Thickness: 3.0±0.5 mm, according to DIN EN ISO 5084

Width: 8±2 mm

Density: 30-80 kg/m3, ISO 845

In one particular example a particle barrier layer may be used from supplier Trocellen S.P.A., in form of a PE adhesive tape with a width of 10 mm, a thickness of 3 mm and a density 40 g/m$^3$.

As to the second protective layer 26, according to an embodiment, a net-like structure (also called mesh) is used which provides a durable, highly air permeable, protective layer in the upper arrangement that connects the air permeable layer (spacer material) and functional layer laminate to the external environment.

Preferably, a material may be used having an air permeability of >1800 l/m$^2$s (100 Pa), according to ISO 9237 and is made of knit preferably a warp knit made of polyamide like polyamide 6.6 (Nylon). Such a knit is advantageously non fraying. The second protective layer is hydrophobic treated.

The second protective layer 26 replaces the lower end of the upper material 12 in the area of the openings 24 and allows machine lasting without meaningful deformation of the lower end of the upper material 12 due to lasting forces. This guarantees that the openings 24 remain in shape and position. The second protective layer 26 may be attached to the upper material 12 by means of stitching or seam 13 or welding (ultrasonic, hot plate, high frequency), and/or over-injection or coating solutions, surrounding the respective opening 24 or arranged in portions of the circumference of the opening.

In one example the second protective layer is made of 100% polyamide with a double treatment of Melamin Resin, and may have a thickness of 1.2 mm, a weight of 390/400 g/m$^2$ (+/−10%) and an air permeability of around 3000 l/m$^2$ s according to ISO 9237. Such a layer is commercially available for example by company Panatex S.P.A.

Regarding the adhesive as used herein, the following embodiments may be used: The adhesive 23 is preferably applied discontinuously to the first protective layer 22 with a low coverage grid roll and provides a durable bond to the air permeable layer 16 while allowing moisture transport through the uncoated land area. An adhesive material may be used being an atactic polypropylene and/or hot melt resins.

As described above, the lower portion of the upper material 12 and/or the second protective layer 26 is preferably attached to the underside of the insole element 32 using lasting glue. This may be done using a machine lasting process. This process is the final step in making the upper arrangement 20. The sole or sole assembly 30 is then cemented to the upper arrangement 20 by the application of sole adhesive. The sole adhesive is applied across the entire surface of the lower side of the insole 32 and the lasted margin edges 121, 261. Sole adhesive may also be applied on the entire upper surface of the sole assembly 30. In the alternative, the sole 30 may also be injection molded onto the upper arrangement 20.

Although only the lasting version was considered in the described embodiments, the invention is not restricted to this, but is also applicable to all other versions such as using the Strobel seam for closing the upper arrangement. Further, when terms such as top, bottom, above, beneath, vertical, horizontal and so forth are used, this refers to the specific figure and should be understood as related to footwear which is in normal use or placed on the ground.

The invention claimed is:

1. Footwear, comprising a) an upper arrangement and a sole, in which:

b) the upper arrangement comprises b.1) an upper material comprising in a lower peripheral area at least one air permeable portion, b.2) an air-permeable layer arranged in a lower area of the upper arrangement on a sole side above the sole, wherein the air-permeable layer is water vapor permeable and has a three-dimensional structure that permits passage of air at least in the horizontal direction; and b.3) at least one water vapor permeable functional layer arranged on an inner side of the upper material and above the air-permeable layer;

c) wherein the at least one air permeable portion enables the air permeable layer to communicate with outer surroundings such that air is exchanged between the outer surroundings and the air permeable layer, said air permeable portion further enables the water vapor permeable functional layer to communicate with the outer surroundings such that water vapor is transported from an inner side of the functional layer to the outer surroundings;

d) wherein a water vapor permeable first protective layer is arranged between said at least one air permeable portion and said functional layer in at least an area of the at least one air permeable portion above the air-permeable layer, wherein the first protective layer is adapted for protecting the functional layer against particles penetrating through the air permeable portion; and e) wherein the at least one air permeable portion comprises at least one air passage opening in the upper material, said air passage opening comprising an air permeable second protective layer.

2. The footwear according to claim 1, wherein the at least one air passage opening has a total area of at least 500 $mm^2$.

3. The footwear according to claim 1, wherein the second protective layer has an air permeability of at least 100 $l/m^2/sec$ at 100 Pa pressure difference.

4. The footwear according to claim 1, wherein the second protective layer has a net structure and is adapted to have protective function against particles, particularly stones.

5. The footwear according to claim 1, wherein the first protective layer is chosen from a group of materials consisting of: woven, nonwoven, felt, knit, porous, non porous, foam and mesh material and combinations thereof.

6. The footwear according to claim 1, wherein the upper arrangement comprises an insole element arranged below the air permeable layer and assembled to at least one of a lower peripheral area of the upper material and a lower area of the air permeable portion.

7. Footwear, comprising a) an upper arrangement and a sole, in which:

b) the upper arrangement comprises b.1) an upper material comprising in a lower peripheral area at least one air permeable portion, b.2) an air-permeable layer arranged in a lower area of the upper arrangement on a sole side above the sole, wherein the air-permeable layer is water vapor permeable and has a three-dimensional structure that permits passage of air at least in the horizontal direction; and b.3) at least one water vapor permeable functional layer arranged on an inner side of the upper material and above the air-permeable layer;

c) wherein the at least one air permeable portion enables the air permeable layer to communicate with outer surroundings such that air is exchanged between the outer surroundings and the air permeable layer, said air permeable portion further enables the water vapor permeable functional layer to communicate with the outer surroundings such that water vapor is transported from an inner side of the functional layer to the outer surroundings;

d) wherein a water vapor permeable first protective layer is arranged between said at least one air permeable portion and said functional layer in at least an area of the at least one air permeable portion above the air-permeable layer, wherein the first protective layer is adapted for protecting the functional layer against particles penetrating through the air permeable portion; and e) wherein the first protective layer extends into a bottom area of the upper arrangement facing the sole and is situated between the water vapor permeable functional layer and the air-permeable layer.

8. The footwear according to claim 7, wherein the first protective layer is provided with attaching means, particularly adhesive in discontinuous distribution, on an inner and outer surface of the first protective layer.

9. The footwear according to claim 1, wherein the first protective layer is different from the second protective layer.

10. The footwear according to claim 1, wherein the first protective layer has a water vapor permeability, moisture vapor transmission rate, of at least 4 $mg/cm^2/h$.

11. The footwear according to claim 1, wherein the first protective layer is adapted to protect the functional layer against dust and abrasion.

12. The footwear according to one of claim 1, wherein the upper arrangement comprises at least one particle barrier layer arranged between the at least one air permeable portion and the functional layer at a level above the air-permeable layer.

13. The footwear according to claim 12, wherein the particle barrier layer is arranged so as to contact an inside surface of the air permeable portion.

14. The footwear according to claim 12, wherein the particle barrier layer is impermeable to air.

15. The footwear according to claim 12, in which the particle barrier layer is attached to the first protective layer.

16. The footwear according to claim 1, wherein the at least one functional layer is comprised of a sock bootie.

17. The footwear according to claim 1, wherein the at least one functional layer is waterproof.

* * * * *